United States Patent [19]

Takahashi et al.

[11] Patent Number: 4,702,778

[45] Date of Patent: Oct. 27, 1987

[54] METHOD FOR SOFTENING ROLLED MEDIUM CARBON MACHINE STRUCTURAL STEELS

[75] Inventors: Toshihiko Takahashi; Toshimi Tarui, both of Sagamihara; Hiroshi Sato, Kamaishi, all of Japan

[73] Assignee: Nippon Steel Corporation, Tokyo, Japan

[21] Appl. No.: 821,550

[22] Filed: Jan. 22, 1986

[30] Foreign Application Priority Data

Jan. 28, 1985 [JP] Japan ..... 60-13891

[51] Int. Cl.[4] ..... C21D 8/00

[52] U.S. Cl. ..... 148/12 F; 148/12.1

[58] Field of Search ..... 148/12 F, 12.1, 12.4, 148/12 R, 36

[56] References Cited

FOREIGN PATENT DOCUMENTS

| | | | |
|---|---|---|---|
| 55-28302 | 2/1980 | Japan | 148/12 F |
| 57-35623 | 2/1982 | Japan | 148/12 F |
| 57-73123 | 5/1982 | Japan | 148/12 F |
| 57-89430 | 6/1982 | Japan | 148/12 F |
| 57-89429 | 6/1982 | Japan | 148/12 F |
| 58-107416 | 6/1983 | Japan . | |
| 59-13024 | 1/1984 | Japan . | |
| 59-126720 | 7/1984 | Japan . | |
| 59-126721 | 7/1984 | Japan . | |
| 59-136421 | 8/1984 | Japan . | |
| 59-136422 | 8/1984 | Japan . | |
| 59-136423 | 8/1984 | Japan . | |
| 921838 | 3/1963 | United Kingdom . | |
| 961430 | 6/1964 | United Kingdom . | |
| 1477377 | 6/1977 | United Kingdom . | |

OTHER PUBLICATIONS

"Tetsu to Hagane (Iron and Steel)", 70, 5, 236, 1984.

*Primary Examiner*—Melvyn J. Andrews
*Assistant Examiner*—Deborah Yee
*Attorney, Agent, or Firm*—Wenderoth, Lind & Ponack

[57] ABSTRACT

A method of softening a rolled medium carbon machine structural steel is provided. This method is characterized by:

(1) hot rolling steel containing 0.32–0.65% C, less than 0.05% Si, 0.3–0.9% in total of Mn and Cr, with the Mn and Cr contents being 0.2–0.5% and 0.1–0.5%, respectively, 0.005–0.1% Al, less than 0.02% P and less than 0.02% S, all percents being on a weight basis, and the balance being Fe and incidental impurities; and (2) performing either one of the following softening treatments:

(i) slowly cooling the as-rolled steel at a cooling rate of 3°–30° C./min over the temperature range of from 750° C. to the point where transformation to pearlite is completed to thereby provide the rolled steel with a strength of not greater than $30+65\times C$ % (kg/mm$^2$), C % signifying the carbon content of the steel; or as-rolled quenching the hot rolled steel to a temperature within the range of 670°–720° C., holding the steel in this temperature range for 4–60 minutes, and then air-cooling the steel to thereby provide the rolled steel with a strength of not greater than $30+65\times C$ % (kg/mm$^2$), C % signifying the carbon content of the steel.

9 Claims, No Drawings

METHOD FOR SOFTENING ROLLED MEDIUM CARBON MACHINE STRUCTURAL STEELS

BACKGROUND OF THE INVENTION

1. Field of the Invention

The present invention relates to a method of softening rolled medium carbon machine structural steels, particularly those which are to be worked into bolts, nuts, shafts and other shapes by cold forging.

2. Prior Art

Prior to the production of machine parts from medium carbon machine structural steels by cold forging, the steels are customarily subjected to cementite spheroidization annealing with a view to softening them, or reducing their resistance to deformation. This softening treatment takes as long as 10–20 hours and it has long been desired to develop a soft rolled steel that needs no spheroidization annealing, thereby achieving improved productivity or reduced energy consumption.

While various proposals have been made in an attempt at attaining this object, "Tetsu to Hagane (Iron and Steel)", 70, 5, 236, 1984 proposes that the medium carbon machine structural steels specified in the currently effective JIS (e.g. S45C and SCM435) should be softened by rolling at low temperatures near 675° C. and by subsequently holding them at a specified temperature. This method, however, is not considered a satisfactory solution because rolling in the low temperature range will cause surface defects in wires or reduce the durability of working rolls.

There exists much patent literature proposing techniques for the need to eliminate spheroidization annealing. Laid-Open Japanese Patent Publication No. 107416/1983 shows a softening method wherein a steel is roughing-rolled to achieve a reduction in thickness of 30% or more at temperatures not lower than 1,000° C., then finish-rolled to achieve further reduction in thickness of 50% or more in the temperature range of 750°–1,000° C. and, thereafter, is cooled to the end point of transformation at a cooling rate not faster than 1° C./sec. Laid-Open Japanese Patent Publication No. 13024/1984 shows a carbide spheroidization technique wherein a steel is finish-rolled to achieve a reduction in thickness of 30% or more in a temperature within the limits of a value not higher than the $Ar_1$ point and one not lower than the point of $Ar_1$ minus 50° C., and the rolled steel is reheated in the temperature range of $Ac_1$–$Ac_3$. Laid-Open Japanese Patent Publication No. 126720/1984 discloses a carbide spheroidization technique wherein a steel is finish-rolled to achieve a reduction in thickness of 80% or more in a temperature range within the limits of a value not higher than the $Ar_1$ point and one not lower than the point of $Ar_1$ minus 50° C., and the rolling operation then is finished at a temperature in the range of $Ac_1$–$Ac_3$ by using the heat resulting from rolling. In the method shown in Laid-Open Japanese Patent Publication No. 126721/1984, the rolled steel is immediately cooled to produce a spheroidized carbide. Laid-Open Japanese Patent Publication No. 136421/1984 proposes a carbide spheroidization technique wherein a steel is finish-rolled to achieve a reduction in thickness of 10% or more in a temperature range within the limits of a value not higher than $Ar_1$ and one not lower than the point of $Ar_1$ minus 200° C., the rolled steel is heated to a temperature in the range defined by a value not higher than the $Ac_3$ point and one not lower than the point of $Ac_1$ minus 100° C. using the heat resulting from rolling, and the steel then is cooled from that temperature to 500° C. at a cooling rate not faster than 100° C./sec. In the method disclosed in Laid-Open Japanese Patent Publication No. 136422/1984, the heated steel is held for 7 minutes or longer in the temperature range defined by a value not higher than the $Ae_1$ point and one not lower than 500° C., so as to produce a spheroidized carbide. The method shown in Laid-Open Japanese Patent Publication No. 136423/1984 attains the same object by subjecting the steel to repeated cycles of controlled rolling wherein the steel being rolled is cooled to a temperature not higher than the $Ar_1$ point but not lower than the point of $Ar_1$ minus 200° C., subsequently rolled to achieve a reduction in thickness of 15% or more, and heated to a temperature not lower than the $Ac_1$ point but not higher than the $Ac_3$ point by using the heat of deformation. Each of these techniques, however, involves the problems of increased surface defects and reduced durability of working rolls since, in comparison with ordinary hot rolling which is finished at about 1,000° C., these techniques have to attain great decreases in thickness at lower temperatures.

As is well known (see, for example, Laid-Open Japanese Patent Publication No. 136421/1984 mentioned above), rolled medium carbon steels usually have either the pearlite or ferrite-pearlite structure. Therefore, in order to reduce the strength of rolled medium carbon steels, it is necessary to reduce the strength of the pearlite that accounts for the greater part of the structure. In view of the generally established theory that the strength of pearlite is inversely proportional to the interlamellar spacing of the cementite in the pearlite, the interlamellar spacing must be increased if one wants to decrease the pearlitic strength.

However, the interlamellar spacing of cementite in the pearlite is uniquely determined by the temperature at which pearlite transformation occurs from austenite, and the higher the transformation point, the more coarse the interlamellar spacing of the cementite. This means that in order to soften a rolled medium carbon steel, transformation to pearlite must be occurred at high temperatures by either cooling the as-rolled steel slowly or by immediately holding the as-rolled steel at the highest possible temperature in the range wherein such pearlite transformation takes place. However, the rate at which the pearlite transformation proceeds decreases with increasing temperatures and an excessively long period is required before the transformation is completed if it is transformed at higher temperatures. The problem is that whichever of the two softening methods is employed, the equipment or production line available today has inherent limitation with regard to the rate of slow cooling or the period for which the rolled steel is maintained at the highest temperature that is practically possible.

SUMMARY OF THE INVENTION

The present inventors analyzed the aforementioned observations on the prior art and made various studies on the factors that would govern the strength properties of rolled medium carbon machine structural steels. As a result, the inventors found that the two objectives, i.e., an increase in the interlamellar spacing of the cementite in pearlite, which is a very effective means for softening or reducing the strength of the medium carbon steel, and completing the pearlite transformation at the high-temperature in a shorter period which is crucial to the purpose of softening the rolled medium carbon steel, can be attained simultaneously by substituting Cr for part of the Mn in the prior art medium carbon steel and by employing the appropriate conditions for cooling or holding the hot rolled steel. The present invention has been accomplished on the basis of these findings.

The primary object, therefore, of the present invention is to provide a process that enables the production of a rolled medium carbon machine structural steel having softness and cold forgeability comparable to those of the conventional spheroidization annealed product by means of optimizing the steel composition and the conditions of cooling subsequent to hot rolling.

The method of the present invention for softening a rolled medium carbon machine structural steel is characterized by:

(1) hot rolling a steel containing 0.32–0.65% C, less than 0.05% Si, 0.3–0.9% in total of Mn and Cr, with the Mn and Cr contents being 0.2–0.5% and 0.1–0.5%, respectively, 0.005–0.1% Al, less than 0.02% P and less than 0.02% S, an optional element which is either (A) or (B) or both, (A) being at least one element selected from the group consisting of not more than 1% Ni, not more than 1% Cu and not more than 0.3% Mo, and (B) being at least one element selected from the group consisting of 0.002–0.05% Ti, 0.0005–0.02% B, 0.005–0.05% Nb and 0.005–0.2% V, all percents being on a weight basis, and the balance being Fe and incidental impurities; and (2) performing either one of the following softening treatments:

(i) slowly cooling the hot rolled steel, from 750° C. until transformation to pearlite is completed, at a cooling rate of 3°–30° C./min; or (ii) immediately quenching the hot rolled steel to a temperature within the range of 670°–720° C., holding the steel in this temperature range for 4–60 minutes, and air-cooling the steel.

DETAILED DESCRIPTION OF THE INVENTION

The term "softening" used herein means that the tensile strength of a rolled steel of interest is decreased to no higher than $30+65\times C\%$ (kg/mm$^2$), the value of strength indicated by the carbon content (C%) of that steel. This formula was obtained by regression analysis for the carbon range of 0.2–0.7%. The value 30 in the first term depends on the strengths of ferrite and pearlite, and 65 in the second term depends on the carbon content, hence, the amount of pearlite. The rolled steel cannot be considered to have been softened if its tensile strength exceeds the value obtained by substituting its carbon content for C% in the formula.

The criticality of each of the components of the steel to be treated by the method of the present invention and that of the range of its amount are described hereinafter.

The carbon (C) is an element essential for the purpose of providing the cold forged product with the necessary strength by subsequent quenching and tempering. If the C content is less than 0.32%, the necessary strength is not obtained. If the C content exceeds 0.65%, no corresponding increase in strength can be attained by subsequent quenching or tempering. Therefore, the C content is limited to the range of 0.32–0.65%.

Silicon (Si) has a solid solution hardening effect and is deleterious to the purpose of the present invention since it will increase the strength of the rolled steel. Therefore, the Si content is limited to less than 0.05% at which proportion its solid solution hardening is negligible. In spite of such a low Si content, there is no possibility of decrease in the hardenability that is required for quenching treatment.

The most important aspect of the present invention lies in the combined addition of Mn and Cr in specified amounts. The JIS specifies that S45C, a typical prior art medium carbon machine structural steel, should contain 0.42–0.48% C, 0.15–0.35% Si and 0.60–0.90% Mn. The temperature at which the transformation to ferrite begins, as well as the temperatures at which the transformation to pearlite—one of the crucial points for softening medium carbon steels—begins and ends, respectively, are raised in comparison with S45C by substituting Cr for part of the Mn in S45C. This means that such a modified steel will transform to pearlite in the same temperature range even if it is cooled more rapidly than S45C. In addition, the temperature at which this steel transforms to pearlite is shifted to the high temperature side, so the transformation to pearlite can be completed within a shorter period even if the as-rolled steel is held at a temperature close to the $A_1$ point. The present inventors confirmed by experiments that completing the transformation to pearlite in rolled S45C took as many as 150 minutes when it was held at 700° C. whereas with the modified steel whose Mn content was partly replaced by Cr, it took only 4 minutes to complete the transformation to pearlite.

In accordance with the present invention, the total content of Mn and Cr in the steel is limited to the range of 0.3–0.9%, with the individual contents of Mn and Cr being within the respective ranges of 0.2–0.5% and 0.1–0.5%. In order to ensure rapid completion of the transformation to pearlite in the high temperature region, the highest proportions of Mn should be replaced by Cr. However, if the Mn content is less than 0.2%, the sulfur in the steel cannot be sufficiently fixed to prevent hot brittleness. If, on the other hand, the Mn content exceeds 0.5%, the addition of Cr is ineffective for the purpose of ensuring rapid completion of the transformation to pearlite at elevated temperatures. Therefore, the Mn content is limited to the range of 0.2–0.5%.

Chromium (Cr) is an element essential for the purpose of accelerating the transformation to pearlite at high temperatures, but this effect cannot be achieved if the Cr content is less than 0.1%. If, on the other hand, the Cr content exceeds 0.5%, the hardenability of the steel is so much increased as to lower the temperature at which transformation to pearlite takes place. Therefore, the Cr content is limited to the range of 0.1–0.5%.

The sum of the Mn and Cr contents is limited to the range of 0.3–0.9%. If Mn and Cr are less than 0.3% in total, the desired hardening effect is not ensured by the quenching that is performed subsequent to forging operations. If the sum of Mn and Cr exceeds 0.9%, an unduly long time is required for completion of the transformation to pearlite.

Aluminum (Al) is added for the purpose of preventing coarsening of austenite grains when the forged product is quenched. If the Al content is less than 0.005%, it is ineffective. If the Al content exceeds 0.1%, not only is the effect of aluminum in suppressing the coarsening of austenite grains saturated but also the cold forgeability of the steel is reduced. Therefore, the Al content is limited to the range of 0.005–0.1%.

Both phosphorus (P) and sulfur (S) reduce the cold forgeability of the steel, and their deleterious effects become noticeable if the content of each element is 0.02% or higher. Therefore, each of P and S is limited to less than 0.02%.

While the essential components of the steel to be treated by the present invention have been described above, said steel may optionally contain a component (A) which consists of at least one element selected from the group comprising not more than 1% Ni, not more than 1% Cu and not more than 0.3% Mo for the purposes of improving the strength and toughness of the steel. Alternatively, the steel may contain another optional component (B) which consists of at least one element selected from the group comprising 0.002–0.05% Ti, 0.0005–0.02% B, 0.005–0.05% Nb and 0.005–0.2% V for the purpose of accelerating transformation to pearlite in the high temperature range. If desired, both components (A) and (B) may be incorporated.

Nickel of group (A) is added for the purpose of improving not only the toughness of the steel but also its hardenability, and hence its strength. The upper limit of the Ni content is 1%, beyond which the hardenability of the steel is so much increased as to cause harmful effects on its cold forgeability. Copper is also effective in improving the toughness and hardenability of the steel, but the upper limit of its content is again set at 1%, beyond which point the effectiveness of Cu is saturated. Molybdenum provides improved hardenability and exhibits high resistance against the softening of the steel upon tempering. The upper limit of the Mo content is 0.3% since no commensurate advantage will result if more than 0.3% Mo is used.

Each of the elements in group (B) is added for the purpose of accelerating the transformation to pearlite in the high temperature range. It is more effective to add Ti and B in combination than when they are added individually; Ti is added to fix N together with Al, thereby maximizing the capability of B to increase hardenability. If the hardenability of the forged product to be quenched is increased by means of the addition of Ti and B, the required total amount of Mn and Cr can be reduced, thereby ensuring even more rapid transformation to pearlite in the high temperature range. If the Ti content is less than 0.002%, the desired N fixing effect is not obtained. If, on the other hand, the Ti content exceeds 0.05%, coarse TiN and TiC will form which reduce both the cold forgeability and toughness of the steel. Therefore, the Ti content is limited to the range of 0.002–0.05%. If the B content is less than 0.0005%, no desirable effect is exhibited by the boron present (i.e., increased hardenability). If the B content exceeds 0.02%, a coarse B compound will be precipitated, leading to lower toughness. Therefore, the B content is limited to the range of 0.0005–0.02%. Each of Nb and V is added for the purpose of accelerating the transformation to pearlite by refining on the austenite grains in the rolled steel, but no such refining effect is attained if the content of each element is less than 0.005%. If the contents of Nb and Y exceed 0.05% and 0.2%, respectively, coarse carbonitrides of Nb and V will be precipitated, leading to reduced toughness and cold forgeability. Therefore, the Nb and V contents are limited to the ranges of 0.005–0.05% and 0.005–0.2%, respectively.

In accordance with the present invention, the as-hot rolled product of the steel defined above is subjected to one of the following softening treatments:

(i) slowly cooling the rolled steel from 750° C. until transformation to pearlite is completed at a cooling rate of 3°–30° C./min., preferably 3°–15° C./min; or (ii) immediately quenching the rolled steel to a temperature within the range of 670°–720° C., holding the steel in this temperature range for 4–60 minutes, and air-cooling the steel. Whichever method is employed, transformation to pearlite in the high temperature range can be completed within a short period and a tensile strength not greater than $30+65\times C\%$ ($kg/mm^2$) can be attained.

In the first method (i), the hot-rolled steel is slowly cooled at a rate of 3°–30° C./min because if the cooling rate is faster than 30° C./min, the temperature at which transformation to pearlite occurs drops to such a level that the purpose of softening the steel cannot be attained. The slower the cooling rate, the better the results that are obtained; but the lower limit is 3° C./min because slower rates are not practical in view of the nature of both the equipment and the production line. If the above specified range of cooling rate is observed, the hot-rolled steel may be immediately cooled to the temperature at which transormation to pearlite is completed, but given the steel composition shown in the previous pages, satisfactory results will be obtained by slow cooling from 750° C. Slow cooling should be continued until transformation to pearlite is completed because if it is stopped prematurely, pearlite or bainite will form as a result of low-temperature transformation in the subsequent air-cooling step and an undesirably hard product will result. The temperature at which transformation to pearlite is completed will vary with the steel species, but with the steel having the composition specified hereinabove, transformation to pearlite will be completed at about 680° C.

The hot-rolled steel may be softened by employing the second method (ii), wherein the steel is immediately quenched to a temperature within the range of 670°–720° C., subsequently held in this temperature range for 4–60 minutes, and air-cooled. The upper limit of the holding temperature is 720° C. because if it is higher than 720° C., an impracticably long period is necessary for completing transformation to pearlite. The lower limit of the holding temperature is 670° C. because if it is lower than 670° C., the strength of the pearlite section is so much increased that the desired soft product will not be obtained. A holding time shorter than 4 minutes is insufficient to complete transformation to pearlite. On the other hand, transformation to pearlite will be completed within 60 minutes if the steel is held within the temperature range of 670°–720° C. Therefore, the holding time is limited to the range of 4–60 minutes. Subsequent to the holding operation, the steel is air-cooled because transformation to pearlite has been completed by the preceding holding step and subsequent slow cooling is not needed at all.

The heating temperature, reduction in thickness, finishing temperature, and other conditions for hot rolling the steel are by no means critical to the purposes of the present invention.

The following example is provided for the purpose of further illustrating the advantages of the present invention but is by no means intended as limiting.

EXAMPLE

Steel samples having the compositions shown in Table 1 were hot-rolled to 11 mm in diameter under the conditions also shown in Table 1. The as-rolled samples were cooled and otherwise treated under the conditions listed in Table 1. Sample Nos. 1, 3, 5, 7, 8, 9, 11–13, 23–29, 31, and 36–39 were in accordance with the present invention, and the other samples were comparative. The treated samples were checked for their tensile strength, cold forgeability, and toughness after quenching and tempering. The test pieces for tensile test were prepared in accordance with JIS 14A. Test pieces machined to 11 mm in diameter and 21 mm in length were used in evaluation of cold forgeability that involved a compression test at the true strain 2; those pieces that did not develop any cracking were rated O while those which developed cracking were rated X. In order to investigate the toughness values after quenching and tempering, the samples were heated at 900° C. for 30 minutes, oil-quenched, tempered at 600° C. for 1 hour, worked into test pieces in compliance with JIS3, and subjected to an impact test at 20° C. The results of these tests are summarized in Table 1.

As will be apparent from Table 1, the samples of rolled steel treated by the present invention had tensile strength values well below $30+65\times C\%$ (kg/cm$^2$), indicating the satisfactory softness of these samples. They were also satisfactory with respect to cold forgeability and toughness after quenching and tempering treatments.

On the other hand, comparative sample Nos. 2, 4, 6, 10 and 30 failed to attain the desired softness because sample Nos. 2 and 30 were cooled too fast after rolling, No. 4 was held at 690° C. for only 3 minutes, No. 6 was held at an undesirably low temperature, and No. 10 was held at an undesirably high temperature.

Comparative sample Nos. 14 to 17 also failed to attain the desired softness because Nos. 14 and 15 had undesirably high Si and Mn contents while they contained no Cr, No. 16 contained too much Mn, and No. 17 contained too much Cr. Sample No. 16 was also poor in cold forgeability because of high Al content.

Comparative sample No. 18 was satisfactory with respect to softness, cold forgeability and toughness after quenching and tempering; however, because of insufficiency in the total amount of Mn and Cr, it could not be hardened to the center of the article even when it was quenched and satisfactory strength was not attainable.

Comparative sample Nos. 19 and 20 also failed to attain the desired softness because No. 19 contained an excessive amount of Si and No. 20 was an undesirably high total content of Mn and Cr. Sample Nos. 21 and 22 had the desired softness but they were very poor with respect to cold forgeability and toughness after quenching and tempering operations because No. 21 had an undesirably high S content and No. 22 contained too much P.

Sample Nos. 32 to 35 attained the desired softness but they were poor in terms of both cold forgeability and toughness after quenching and tempering because these four samples had undesirably high levels of Ti, B, Nb and V, respectively.

TABLE 1

| Sample | Chemical composition of steels (wt %) | | | | | | | | | | | | | |
|---|---|---|---|---|---|---|---|---|---|---|---|---|---|---|
| No. | C | Si | Mn | Cr | Al | P | S | Ni | Cu | Mo | Ti | B | Nb | V |
| 1 | 0.36 | 0.01 | 0.45 | 0.41 | 0.02 | 0.015 | 0.009 | — | — | — | — | — | — | — |
| 2 | 0.36 | 0.01 | 0.45 | 0.41 | 0.02 | 0.015 | 0.009 | — | — | — | — | — | — | — |
| 3 | 0.45 | 0.01 | 0.30 | 0.39 | 0.025 | 0.012 | 0.013 | — | — | — | — | — | — | — |
| 4 | 0.45 | 0.01 | 0.30 | 0.39 | 0.025 | 0.012 | 0.013 | — | — | — | — | — | — | — |
| 5 | 0.51 | 0.03 | 0.34 | 0.32 | 0.013 | 0.008 | 0.006 | — | — | — | — | — | — | — |
| 6 | 0.51 | 0.03 | 0.34 | 0.32 | 0.013 | 0.008 | 0.006 | — | — | — | — | — | — | — |
| 7 | 0.62 | 0.01 | 0.24 | 0.35 | 0.045 | 0.010 | 0.008 | — | — | — | — | — | — | 0.03 |
| 8 | 0.42 | 0.02 | 0.35 | 0.31 | 0.009 | 0.012 | 0.014 | 0.72 | — | — | — | — | — | — |
| 9 | 0.38 | 0.01 | 0.34 | 0.37 | 0.029 | 0.014 | 0.010 | — | 0.82 | — | — | — | — | — |
| 10 | 0.38 | 0.01 | 0.34 | 0.37 | 0.029 | 0.014 | 0.010 | — | 0.82 | — | — | — | — | — |
| 11 | 0.50 | 0.04 | 0.29 | 0.24 | 0.076 | 0.007 | 0.004 | — | — | 0.13 | — | — | — | — |
| 12 | 0.45 | 0.02 | 0.31 | 0.29 | 0.024 | 0.011 | 0.012 | — | — | — | 0.015 | 0.0020 | — | — |
| 13 | 0.45 | 0.01 | 0.30 | 0.38 | 0.025 | 0.013 | 0.013 | 0.21 | — | — | — | — | 0.012 | — |
| 14 | 0.44 | 0.24 | 0.76 | — | 0.021 | 0.016 | 0.009 | — | — | — | — | — | — | — |
| 15 | 0.55 | 0.26 | 0.78 | — | 0.026 | 0.019 | 0.018 | — | — | — | — | — | — | — |
| 16 | 0.43 | 0.04 | 0.72 | 0.20 | 0.115 | 0.013 | 0.008 | — | — | — | — | — | — | — |
| 17 | 0.38 | 0.02 | 0.31 | 0.71 | 0.041 | 0.022 | 0.013 | — | — | — | — | — | — | — |
| 18 | 0.46 | 0.04 | 0.15 | 0.13 | 0.026 | 0.015 | 0.013 | — | — | — | — | — | — | — |
| 19 | 0.45 | 0.15 | 0.34 | 0.40 | 0.030 | 0.012 | 0.006 | — | — | — | — | — | — | — |
| 20 | 0.48 | 0.03 | 0.57 | 0.50 | 0.055 | 0.018 | 0.009 | — | — | — | — | — | — | — |
| 21 | 0.55 | 0.02 | 0.35 | 0.36 | 0.030 | 0.012 | 0.035 | — | — | — | — | — | — | — |
| 22 | 0.50 | 0.01 | 0.34 | 0.28 | 0.023 | 0.033 | 0.018 | — | — | — | — | — | — | — |
| 23 | 0.43 | 0.02 | 0.21 | 0.11 | 0.031 | 0.011 | 0.008 | — | — | — | — | 0.0031 | — | — |
| 24 | 0.49 | 0.02 | 0.34 | 0.43 | 0.063 | 0.008 | 0.010 | — | — | — | 0.010 | — | — | — |
| 25 | 0.39 | 0.04 | 0.32 | 0.32 | 0.060 | 0.009 | 0.007 | — | — | 0.10 | — | 0.0022 | — | — |
| 26 | 0.40 | 0.03 | 0.31 | 0.35 | 0.060 | 0.007 | 0.007 | — | — | — | 0.013 | 0.0025 | 0.013 | — |
| 27 | 0.39 | 0.03 | 0.33 | 0.34 | 0.058 | 0.008 | 0.007 | — | — | — | 0.016 | 0.0023 | — | 0.04 |
| 28 | 0.46 | 0.04 | 0.25 | 0.30 | 0.045 | 0.012 | 0.006 | — | — | — | 0.015 | 0.0019 | 0.015 | 0.02 |
| 29 | 0.45 | 0.03 | 0.45 | 0.23 | 0.039 | 0.008 | 0.006 | 0.33 | — | 0.21 | — | — | — | — |
| 30 | 0.44 | 0.02 | 0.47 | 0.25 | 0.040 | 0.008 | 0.006 | 0.31 | — | 0.22 | — | — | — | — |
| 31 | 0.33 | 0.03 | 0.31 | 0.40 | 0.038 | 0.016 | 0.007 | — | — | 0.15 | — | 0.0015 | 0.011 | — |
| 32 | 0.35 | 0.04 | 0.44 | 0.40 | 0.029 | 0.012 | 0.013 | 0.12 | — | — | 0.052 | 0.0030 | — | — |
| 33 | 0.33 | 0.04 | 0.43 | 0.39 | 0.061 | 0.015 | 0.007 | — | — | — | 0.014 | 0.0204 | — | — |
| 34 | 0.41 | 0.02 | 0.29 | 0.45 | 0.058 | 0.008 | 0.006 | 0.12 | — | — | 0.013 | 0.0018 | 0.051 | — |
| 35 | 0.38 | 0.03 | 0.35 | 0.28 | 0.037 | 0.009 | 0.016 | — | — | 0.17 | — | — | — | 0.22 |
| 36 | 0.51 | 0.04 | 0.34 | 0.39 | 0.027 | 0.009 | 0.012 | — | — | 0.16 | 0.015 | 0.0016 | 0.012 | — |
| 37 | 0.52 | 0.01 | 0.29 | 0.40 | 0.062 | 0.0015 | 0.010 | — | — | 0.21 | 0.014 | 0.0016 | 0.013 | 0.01 |
| 38 | 0.39 | 0.01 | 0.31 | 0.41 | 0.049 | 0.0013 | 0.007 | — | — | 0.20 | 0.017 | 0.0024 | — | — |
| 39 | 0.45 | 0.03 | 0.34 | 0.35 | 0.048 | 0.0011 | 0.008 | 0.21 | — | 0.19 | — | 0.0021 | 0.015 | — |

| Sample | Rate of cooling after rolling* | Holding after rolling** temperature | Holding after rolling** time | 30 + 65 × C % | Tensile strength of rolled steel | Cold | Toughness value, |
|---|---|---|---|---|---|---|---|

TABLE 1-continued

| No. | (°C./min) | (°C.) | (min) | (kg/mm²) | (kg/mm²) | forgeability | uE20 (kgm/²) |
|---|---|---|---|---|---|---|---|
| ① | 6 | — | — | 53.4 | 48 | | 15.4 |
| 2 | 40 | — | — | 53.4 | 58 | | 14.7 |
| ③ | — | 690 | 15 | 59.3 | 54 | | 12.6 |
| 4 | — | 690 | 3 | 59.3 | 63 | | 13.0 |
| ⑤ | — | 680 | 45 | 63.2 | 57 | | 8.6 |
| 6 | — | 660 | 20 | 63.2 | 69 | | 8.1 |
| ⑦ | 10 | — | — | 70.3 | 62 | | 7.0 |
| ⑧ | 4 | — | — | 57.3 | 50 | | 13.6 |
| ⑨ | — | 710 | 50 | 54.7 | 49 | | 15.0 |
| 10 | — | 725 | 60 | 54.7 | 60 | | 14.2 |
| ⑪ | 3 | — | — | 62.5 | 58 | | 8.3 |
| ⑫ | 12 | — | — | 59.3 | 52 | | 13.0 |
| ⑬ | 8 | — | — | 59.3 | 53 | | 14.9 |
| 14 | 8 | — | — | 58.6 | 62 | | 13.0 |
| 15 | 5 | — | — | 65.8 | 71 | | 4.6 |
| 16 | — | 700 | 60 | 58.0 | 63 | x | 13.6 |
| 17 | 12 | — | — | 54.7 | 59 | | 14.0 |
| 18 | — | 685 | 40 | 59.9 | 53 | | 11.5 |
| 19 | 6 | — | — | 59.3 | 66 | | 10.6 |
| 20 | 9 | — | — | 61.2 | 63 | | 9.5 |
| 21 | 6 | — | — | 65.8 | 60 | x | 3.2 |
| 22 | — | 675 | 30 | 62.5 | 59 | x | 2.3 |
| ㉓ | 8 | — | — | 58.0 | 52 | | 13.5 |
| ㉔ | — | 715 | 45 | 61.9 | 58 | | 13.2 |
| ㉕ | 20 | — | — | 55.4 | 51 | | 14.0 |
| ㉖ | 6 | — | — | 56.0 | 53 | | 15.7 |
| ㉗ | 5 | — | — | 55.4 | 51 | | 13.2 |
| ㉘ | 7 | — | — | 59.9 | 51 | | 11.5 |
| ㉙ | 7 | — | — | 59.3 | 56 | | 12.9 |
| 30 | 35 | — | — | 58.6 | 66 | | 13.4 |
| ㉛ | — | 705 | 25 | 51.5 | 48 | | 13.6 |
| 32 | — | 700 | 30 | 52.8 | 51 | x | 2.1 |
| 33 | — | 700 | 30 | 51.5 | 49 | x | 1.7 |
| 34 | 8 | — | — | 56.7 | 54 | x | 2.1 |
| 35 | 4 | — | — | 54.7 | 52 | x | 1.1 |
| ㊱ | 5 | — | — | 63.2 | 57 | | 13.7 |
| ㊲ | — | 695 | 35 | 63.8 | 56 | | 13.5 |
| ㊳ | 7 | — | — | 55.4 | 51 | | 14.7 |
| ㊴ | — | 710 | 60 | 59.3 | 54 | | 14.1 |

Note: Sample numbers in parentheses refer to the samples of the present invention.
*: Cooling rates were those of slow cooling, subsequent to rolling, from 750° C. to the temperature at which transformation to pearlite was completed.
**: Holding temperatures and times were those for immediate holding at indicated temperatures subsequent to rolling.

As is shown by the data obtained in the example, the method of the present invention enables the production of a rolled medium carbon machine structural steel having softness and cold forgeability comparable to those of the conventional spheroidization annealed product by means of optimizing the steel composition and the conditions of cooling subsequent to hot rolling. The present invention will therefore offer great benefits to the steelmaking industry.

What is claimed is:

1. A method of softening a rolled medium carbon machine structural steel, said method comprising:

(1) hot rolling a steel containing 0.32–0.65%C, less than 0.05% Si, 0.3–0.9% in total of Mn and Cr, with the Mn and Cr contents being 0.2–0.5% and 0.1–0.5%, respectively, 0.005–0.1% Al, less than 0.02% P and less than 0.02% S, all percents being on a weight basis, and the balance being Fe and incidental impurities, and (2) slowly cooling the as-rolled steel at a cooling rate of 3°–30° C./min over the temperature range of from 750° C. to the point where transformation to pearlite is completed to thereby provide the rolled steel with a strength of not greater than $30+65\times C\%$ (kg/mm²), C% signifying the carbon content of the steel.

2. A method of softening a rolled medium carbon machine structural steel, said method comprising:

(1) hot rolling a steel containing 0.32–0.65% C, less than 0.05% Si, 0.3–0.9 in total of Mn and Cr, with the Mn and Cr contents being 0.2–0.5% and 0.1–0.5%, respectively, 0.005–0.1% Al, less than 0.02% P and less than 0.02% S, all percents being on a weight basis, the balance being Fe and incidental impurities, and (2) immediately quenching the as-rolled steel to a temperature within the range of 670°–720° C., holding the steel in this temperature range for 4–60 minutes, and air-cooling the steel to thereby provide the rolled steel with a strength of not greater than $30+65\times C\%$ (kg/mm²), C% signifying the carbon content of the steel.

3. The method according to claim 1 or 2 wherein said steel further contains at least one element selected from the group consisting of not more than 1% Ni, not more than 1% Cu and not more than 0.3% Mo, all percents being on a weight basis.

4. The method according to claim 1 or 2 wherein said steel further contains at least one element selected from the group consisting of 0.002–0.05% Ti, 0.0005–0.02% B, 0.005–0.05% Nb and 0.005–0.2% V, all percents being on a weight basis.

5. The method according to claim 1 or 2 wherein said steel further contains both elements (A) and (B), (A) being at least one element selected from the group consisting of not more than 1% Ni, not more than 1% Cu and not more than 0.3% Mo, and (B) being at least one element selected from the group consisting of 0.002–0.05% Ti, 0.0005–0.02% B, 0.005–0.05% Nb and 0.005–0.2% V, all percents being on a weight basis.

6. The method according to claim 1 or 2 wherein said as-rolled steel is slowly cooled at a cooling rate of 3°–15° C./min.

7. The method according to claim 3 wherein said as-rolled steel is slowly cooled at a cooling rate of 3°–15° C./min.

8. The method according to claim 4 wherein said as-rolled steel is slowly cooled at a cooling rate of 3°–15° C./min.

9. The method according to claim 5 wherein said as-rolled steel is slowly cooled at a cooling rate of 3°–15° C./min.

* * * * *